United States Patent [19]

Massari

[11] Patent Number: 4,457,039

[45] Date of Patent: Jul. 3, 1984

[54] TOOTHBRUSH WITH ANATOMICALLY DESIGNED HANDLE

[76] Inventor: Berardo Massari, Via Gramsci 76, Rozzano (Milano), Italy

[21] Appl. No.: 379,578

[22] Filed: May 17, 1982

[30] Foreign Application Priority Data

Apr. 5, 1982 [IT] Italy ..... 21455/82[U]

[51] Int. Cl.[3] ..... A46B 9/04

[52] U.S. Cl. ..... 15/167 R; 15/143 R; D4/25

[58] Field of Search ..... 15/167 R, 167 A, 143 R, 15/145; D4/15–28

[56] References Cited

U.S. PATENT DOCUMENTS

| | | | |
|---|---|---|---|
| 569,870 | 10/1896 | Hamilton | D4/28 X |
| 669,402 | 3/1901 | Rose | 15/167 R |
| 1,476,579 | 12/1923 | Barnes | 15/167 R |
| 1,513,104 | 10/1924 | Gracey | 15/167 R |
| 1,779,057 | 10/1930 | Tolmach | D4/25 X |
| 3,474,481 | 10/1969 | Soleymani et al. | 15/143 R X |

FOREIGN PATENT DOCUMENTS

| | | | |
|---|---|---|---|
| 2311043 | 9/1974 | Fed. Rep. of Germany | 15/167 R |
| 341008 | 5/1904 | France | D4/25 X |

*Primary Examiner*—Peter Feldman
*Attorney, Agent, or Firm*—Michael J. Striker

[57] ABSTRACT

A toothbrush the handle of which is set back in relation to the cleaning head and is so shaped as to afford optimum adaption to the anatomy of the face and of the hand.

11 Claims, 3 Drawing Figures

TOOTHBRUSH WITH ANATOMICALLY DESIGNED HANDLE

Toothbrushes for cleaning the teeth are commonly known objects. They generally include a continuous handle in a straight line with the bristle-carrying head.

Due to this, and especially in some kinds of toothbrushes, frequent interference occurs during use between the person's hand and chin.

Further, as the handle generally consists of a small plain bar, without any particular shaping either near the head or at its lower extremity, it does little to guide the hand especially the index finger and the little finger. The purpose of the disclosure is to provide a toothbrush which allows for the anatomical features of the mouth and chin, as well as for those of the hand, and which favours the movements needed for cleaning the teeth as will now be explained.

The subject of the disclosure is a toothbrush whose hand grip is set back, in relation to the bristle-carrying head, further than the horizontal distance between the most forward teeth and the external surface of the chin of an average person; in other words, further than the distance, on a horizontal plane, between the point to which the most forward teeth project and the external surface of the chin.

The hand grip is practically speaking rectilinear and parallel to the plane on which lies the surface of the head from which the bristles project.

Connection between the hand grip and the head is realized by an arm whose length is greater than the average anatomic distance between the middle of the mouth and the lower extremity of the chin.

The beginning and the end of the hand grip are marked by projections facing backwards with the aim of creating two ledges to support and guide the fingers of the hand.

The characteristics and purposes of the disclosure will be more clearly shown by the example of its realization described below and illustrated by drawings.

Figure 1:
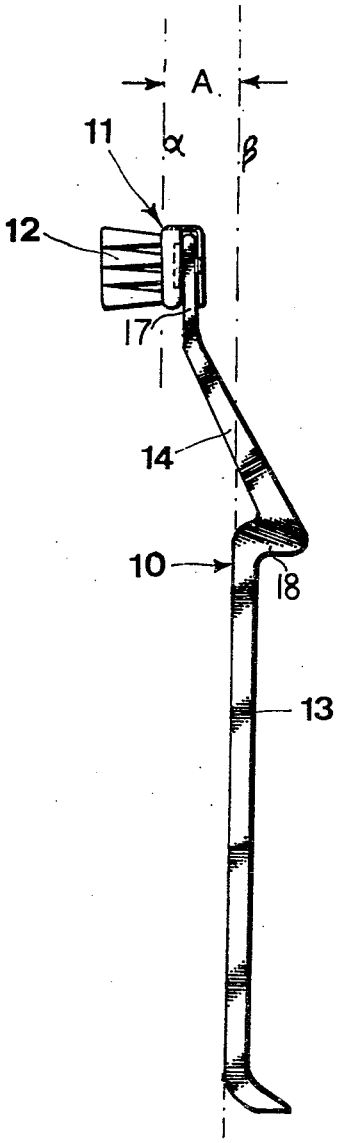

FIG. 1: Profile view of the toothbrush of the invention

Figure 2:
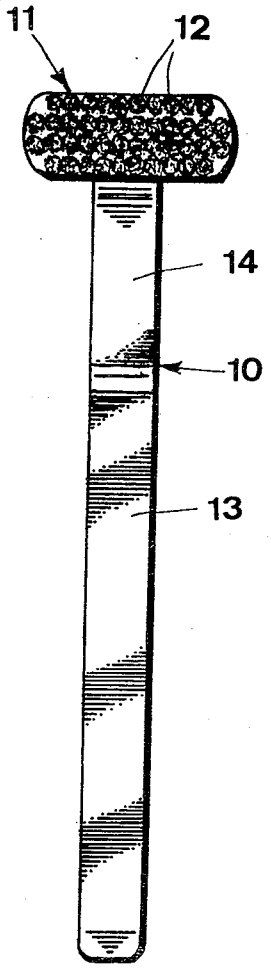

FIG. 2: Toothbrush of the invention seen from the front

Figure 3:
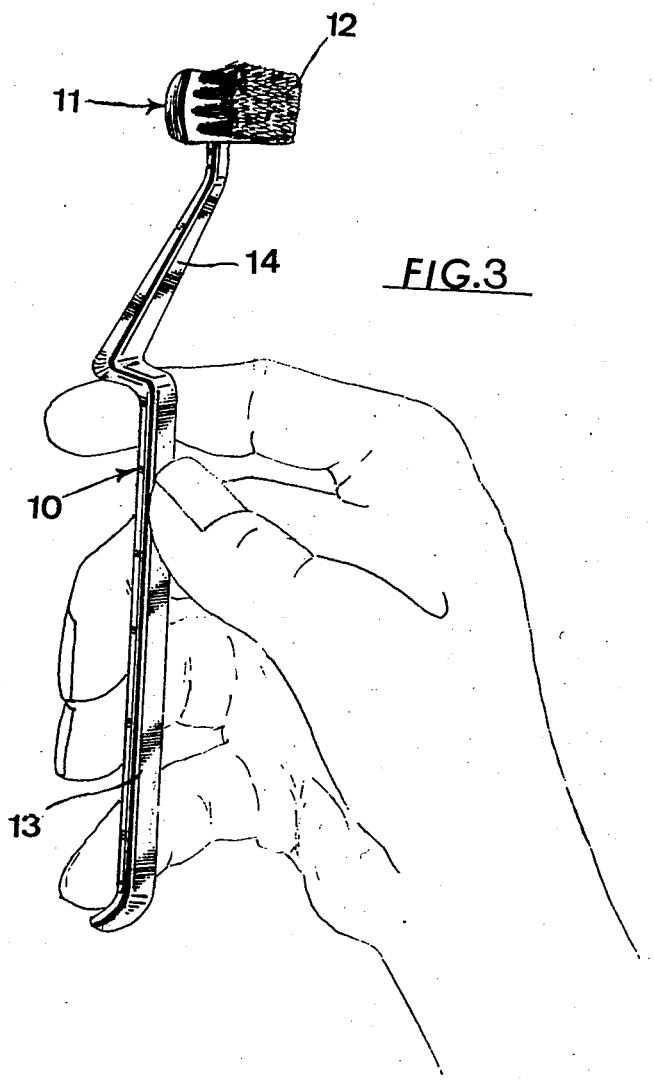

FIG. 3: Toothbrush of the invention held in the hand in use.

The toothbrush is practically speaking composed of the handle (10) and of the head (11) with its bristles (12). The handle includes the hand grip (13) and the arm (14) connecting the hand grip to the head as head mount 17.

The plane on which the hand grip, marked $\beta$, lies, is more or less parallel to the plane of the head marked $\alpha$.

In the example here described the distance A between the two planes $\beta$ and $\alpha$ is about one cm.

The length of the hand grip is about 10 cm while that of the arm (14) is about 4 cm. At the beginning and the end of the hand grip we have the projections (15) and (16) on which the fingers of the hand, respectively the index and the little finger, rest.

The advantages of the disclosure are quite clear.

Any interference between the hand holding the toothbrush and the chin is avoided, especially when the handle is at a different angle in relation to the teeth.

The hand can hold onto the hand grip firmly and conveniently, guided by the upper backward projecting ledge which gives valid support to the index, and by the lower ledge adequately supporting the little finger, joint pressure by the index and the little finger thus opposing that of the thumb pressed against the front of the hand grip. The thin neck supporting the head, in its more forward position compared with the hand grip, enables the teeth farthest back to be perfectly cleaned without causing any inconvenience to the lips and the mouth generally.

Since the applications of the disclosure have been described merely as an example in no way limited to this one, it is understood that any equivalent application of the inventive concepts here set forth and any product executed and/or in operation according to the characteristics of the disclosure are covered by it field of protection.

I claim:

1. A toothbrush, comprising:

a bristle-carrying head;

a plurality of bristles arranged on said bristle-carrying head and having a base and an external surface;

a handle having a straight handgrip which is parallel to said external surface of said bristle-carrying head and has two spaced ends and disposed rearwardly of said external surface, said handgrip also having front and rear surfaces as considered relative to said external surface of said bristles, said handle also having a section connecting said handgrip with said bristle-carrying head; and two projections provided each at said rear surface of said handgrip at a respective one of said ends, so that on said front surface of said handgrip the thumb of the user is supported on said handgrip between said projections, and at the same time on said rear surface of said handgrip one of said projections provides a support for the forefinger whereas the other of said projections provides a support for the little finger of the user so as to counteract by the forefinger and the little finger the force applied by the thumb.

2. The toothbrush as defined in claim 1, wherein the length of said handgrip between said two projections is about 10 cm, the length of said section connecting said head to said handgrip is about 4 cm, and the front surface of said handgrip is set back from said base of said bristles by about 1 cm.

3. The toothbrush as defined in claim 1, wherein said section comprises an arm having two ends and a head mount provided on one of said arm ends for mounting said bristle-carrying head, said other end of said arm being connected with one of said projections at said handgrip.

4. The toothbrush as defined in claim 3, wherein said head mount is elongated, said handgrip being substantially parallel to said head mount.

5. The toothbrush as defined in claim 4, wherein said arm is integrally attached at said one end to said head mount, said other end of said arm being disposed rearwardly of said handgrip.

6. The toothbrush as defined in claim 5, wherein said one projection is disposed substantially perpendicular to said handgrip.

7. The toothbrush as defined in claim 6, wherein said one projection has first and second ends, said other end of said arm being integrally attached to said first end of said one projection so that said one projection is rearwardly disposed.

8. The toothbrush as defined in claim 7, wherein said second end of said one projection is integrally attached to said one end of said handgrip.

9. The toothbrush as defined in claim 8, wherein said other end of said handgrip is integrally attached to said other projection.

10. The toothbrush as defined in claim 9, wherein the surface of said handgrip is sufficiently rough to prevent the fingers from sliding along it.

11. A toothbrush, comprising:

a bristle-carrying head;

a plurality of bristles arranged on said bristle-carrying head and having a base and an external surface which is parallel to said base;

a handle having a straight handgrip with two ends and disposed rearwardly of said external plane of said bristles at a distance greater than the horizontal distance between the teeth and the chin of a user, said handle also having a section connecting said handgrip with said bristle-carrying head and having a length which is greater than the distance between the center of the mouth and the chin of the user so that contact is avoided between the hand and the chin of the user; and two projections provided each rearwardly on said handgrip at a respective one of said ends, so that the hand of the user is supported on said handgrip between said projections and at the same time, one of said projections provides a support for the forefinger whereas the other of said projections provides a support for the little finger of the user.

* * * * *